United States Patent [19]

Jackson

[11] 4,023,320

[45] May 17, 1977

[54] ORNAMENTAL PLASTIC SHUTTER

[75] Inventor: James W. Jackson, East Walpole, Mass.

[73] Assignee: Bird & Son, Inc., East Walpole, Mass.

[22] Filed: July 16, 1976

[21] Appl. No.: 706,061

[52] U.S. Cl. ..... 52/473; 52/314; 52/455

[51] Int. Cl.[2] ..... E06B 7/08; E06B 9/00

[58] Field of Search ..... 52/473, 314, 78, 455, 52/629, 624, 618, 625

[56] References Cited

UNITED STATES PATENTS

| | | | |
|---|---|---|---|
| 1,775,383 | 9/1930 | Auble | 52/78 |
| 3,461,629 | 8/1969 | Smith | 52/314 |
| 3,584,427 | 5/1969 | Johnston | 52/473 |
| 3,782,051 | 1/1974 | Quinif | 52/473 |
| 3,797,186 | 3/1974 | Smith | 52/473 |

*Primary Examiner*—James L. Ridgill, Jr.

[57] ABSTRACT

An integrally molded one-piece ornamental plastic shutter having marginal portions providing peripheral front surfaces and inner and outer top, bottom and side surfaces. A plurality of discrete slats extend between the inner side surfaces. The slats slope downwardly and are parallel to and spaced from one another. Their lower edge portions are extended rearwardly to simulate the appearance and the rigid feel of the slats of a conventional wooden shutter.

7 Claims, 8 Drawing Figures

FIG 1
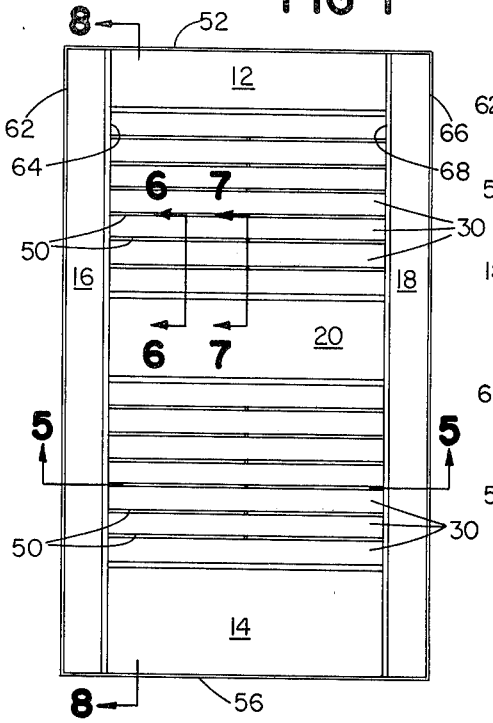
FIG 2
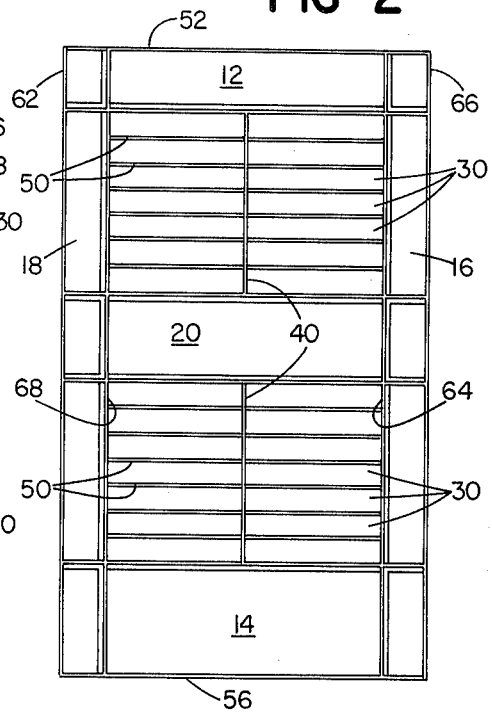
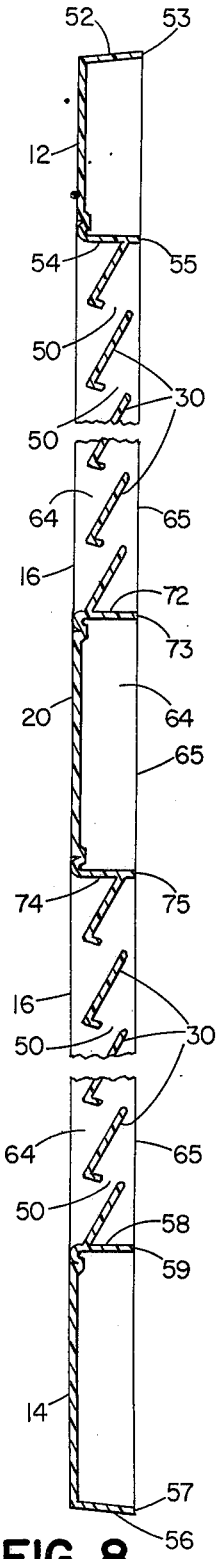
FIG 8
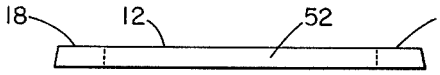
FIG 4
FIG 3
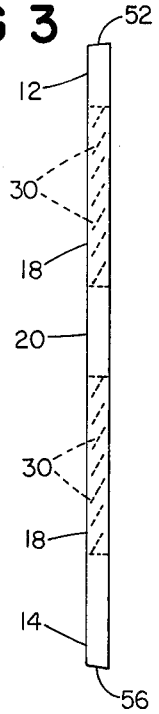
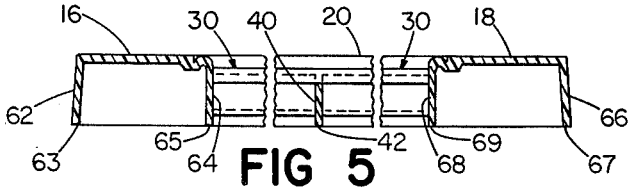
FIG 5
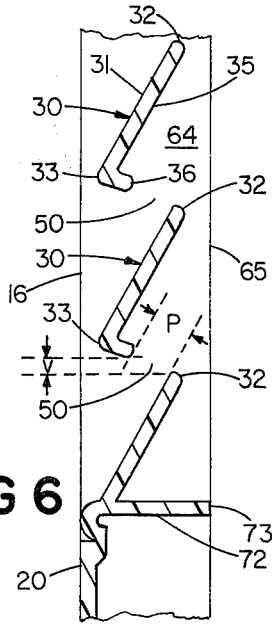
FIG 6
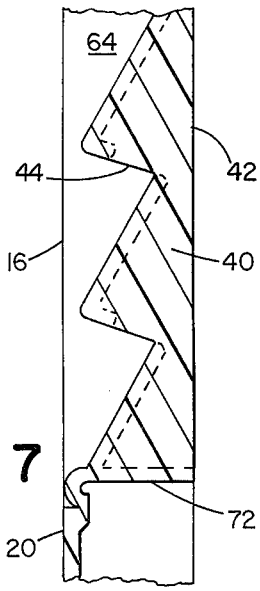
FIG 7

ORNAMENTAL PLASTIC SHUTTER

This invention relates to ornamental shutters, and more particularly to one-piece molded plastic shutters simulating the appearance of a conventional wooden shutter.

Ornamental plastic shutters have long been known, being disclosed, for example, in U.S. Pat. Nos. 3,584,427; 3,797,186 and Des. 217,596. However, the shutters of such patents are all deficient in a number of respects, both from the standpoint of appearance and manufacture. From the standpoint of appearance, it is, of course, desirable to simulate the appearance of a conventional wooden shutter by providing a heavy frame with relatively thick slats. However, from the manufacturing standpoint, this is not practical, because of the great amount and hence high cost of the plastic material which would be necessary. On the other hand, when relatively thin plastic sheets are used, the slat structure, if provided with the usual ventilating openings between the slats, not only fails to provide the desired appearance, but is insufficiently rigid as well. Of course, the slat structure can be continuous, without openings, but although this solves the problem of rigidity, it results in an unsatisfactory appearance.

It is therefore a major object of the present invention to provide a novel, integrally molded, one-piece plastic shutter having ventilating openings between its slats and yet providing slats having both the desired appearance and rigidity.

It is another object of the invention to provide such a shutter which can be injection molded in one piece.

According to the present invention, there is provided a novel, integrally molded one-piece plastic shutter including marginal frame portions of generally "U" shaped configuration providing peripheral front surfaces including top, bottom and side surfaces; peripheral inner and outer surfaces including top, bottom and side surfaces; and peripheral inner and outer rear edges including top, bottom and side edges.

A plurality of discrete slats extend between the inner side surfaces. The slats are generally flat with front surfaces sloping downwardly from their upper rearward edges in a direction from the inner peripheral rear side edges of the marginal frame portions downwardly toward the peripheral front side surfaces of the marginal frame portions. The lower forward edge portions of the slats extend rearwardly beyond the rear surfaces of the slats, providing a thickened bottom edge surface, which not only improves the appearance, but also makes a more rigid slat. The slats are parallel to one another and are spaced from one another, both in a direction along the inner side surfaces of the marginal frame portions and in a direction perpendicular to the plane of the slats, providing substantial openings between their rearwardly extending lower edge portions and their upper edges to simulate the appearance and the rigid feel of a conventional wooden shutter. The slats may be recessed within the marginal frame portions, the front bottom edges of the slats being spaced rearwardly from the front surfaces of the marginal frame portions and the rear upper edges of the slats being spaced forwardly from the rear edges of the marginal frame portions.

The plastic shutter of the invention may also include a narrow slat stiffening portion extending parallel to the inner side surfaces of the marginal frame portions and spaced therebetween, connecting the slats to one another rearwardly thereof. The forward edge of the slat stiffening portion is preferably contiguous with the front surface and lower edge portion of the slats and extends from the lower edge portion of an upper slat to the upper edge of a lower next succeeding slat.

For the purpose of more fully explaining the above and still further objects and features of the invention, reference is now made to the following detailed description of a preferred embodiment thereof, together with the accompanying drawings, wherein:

FIGS. 1, 2, 3 and 4 are, respectively, front, rear, side and top views of the ornamental, integrally molded, one-piece plastic shutter of the invention and FIGS. 5, 6, 7 and 8 are detail sectional views of the shutter of FIGS. 1 through 4 taken, respectively, on section lines 5—5, 6—6, 7—7 and 8—8 of FIG. 1.

Referring to the drawings, the one-piece shutter of the invention has marginal frame portions providing peripheral front surfaces including a top panel 12, a bottom panel 14 and side panels 16 and 18. Extending between side panels 16 and 18 is a central panel 20. Above and below central panel 20, a plurality of parallel slats, generally designated 30, extend between side panels 16 and 18. A slat stiffening portion 40 may also be provided on the rear side of the shutter, said portion extending parallel to side panels 16 and 18 and being spaced centrally therebetween. The entire shutter may be integrally molded by injection molding techniques using high density polystyrene or other suitable plastic.

More specifically, the marginal frame portions of the shutter of the invention, including the central panel 20, are of generally U-shaped configuration, open at the rear of the shutter and, in addition to panels 12, 14, 16, 18 and 20, provide peripheral inner and outer surfaces including top, bottom and side surfaces, as well as peripheral inner and outer rear edges including top, bottom and side edges at the rear side of the shutter. Thus, top panel 12 has an outer surface 52 with rear edges 53 and an inner surface 54, with rear edges 55. Bottom panel 14 has an outer surface 56 with rear edges 57 and an inner surface 58, with rear edges 59. Side panel 16 has an outer surface 62 with rear edges 63 and an inner surface 64 with rear edges 65. Side panel 18 has an outer surface 66 with rear edges 67 and an inner surface 68 with rear edges 69. Central panel 20 has opposite inner surfaces 72 and 74, with rear edges 73 and 75, respectively.

Slats 30 are integral with, and extend between, the inner side surfaces 64 and 68. Each of slats 30 is generally flat and of uniform thickness, with its front surface 31 sloping downwardly from its upper rearward edge 32 in a direction from the inner peripheral rear side edges 65 and 69 downwardly toward the peripheral front side panel surfaces 16 and 18 of the marginal frame portions. The front bottom edge surfaces 33 of slats 30 are spaced rearwardly from the front surfaces 16 and 18 or the marginal frame portions and the rear upper edges 32 of slats 30 may be spaced forwardly from the rear edges 65 and 69 of the marginal frame portions, as shown, although they may also extend rearwardly to said frame portions.

Specifically in accordance with the present invention, slats 30 have a lower forward edge portion 36 extending rearwardly beyond the rear surfaces 35 of the slats, providing a thickened bottom edge surface 33, and are spaced from one another to provide substantial ventilating openings 50 therebetween, thus accurately simulating the appearance and rigid feel of a conventional wooden shutter in this respect.

More specifically, slats 30 are parallel to one another and are spaced from one another both in a vertical direction V along the inner side surfaces 64 and 68 of the marginal frame portions and in a generally horizontal direction P perpendicular to the plane of the slats, providing not only the desired thickened edge 33 but also substantial ventilating openings 50 between their rearwardly extending lower edge surfaces 33 and their upper edges 32, between the lower edge 33 of an upper slat 30 and the upper edge 32 of a next succeeding lower slat 30.

The slat stiffening portion 40 extends parallel to inner side surfaces 64 and 68 of the marginal frame portions and is centrally spaced therebetween. It connects slats 30 to one another rearwardly thereof and its rear edge 42 may lie in the plane of the rear edge of the shutter, but may also be positioned forwardly thereof, not only for further stiffening of the slats, but also further to simulate the appearance and rigid feel of conventional wooden shutters. To this end, the forward edge 44 of slat stiffening portion 40 is contiguous with the front surfaces 31 and lower edge surfaces 33 of slats 30 and extends in a straight line from the lower edge surface 33 of an upper slat 30 to the upper edge 32 of a lower next succeeding slat 30 along a line contiguous with the lower edge surface 33.

By reason of the substantial ventilating openings 50 between slats 30, and the unique thickened bottom edge surfaces 33 of slats 30, the shutter of the present invention not only simulates the appearance of a conventional wooden shutter, but also is suitably rigid. It may readily be installed on a wall by introducing nails or screws through any of its front panels.

What is claimed is:

1. An integrally molded one-piece plastic shutter including marginal frame portions of generally U-shaped configuration providing peripheral front surfaces including top, bottom and side surfaces peripheral inner and outer surfaces including top, bottom and side surfaces and peripheral inner and outer rear edges including top, bottom and side edges and a plurality of discrete slats extending between said inner side surfaces said slats being generally flat with front surfaces sloping downwardly from their upper rearward edges in a direction from the inner peripheral rear side edges of said marginal frame portions downwardly toward the peripheral front side surfaces of said marginal frame portions, said slats having a lower forward edge portion extending rearwardly beyond the rear surfaces thereof providing a thickened bottom edge surface said slats being parallel to one another and being spaced from one another both in a direction along said inner side surfaces of said marginal frame portions and in a direction perpendicular to the plane of said slats providing substantial openings between their rearwardly extending lower edge portions and their upper edges to simulate the appearance of a conventional wooden shutter.

2. A plastic shutter as claimed in claim 1 wherein the front bottom edges of said slats are spaced rearwardly from the front surfaces of said marginal frame portions.

3. A plastic shutter as claimed in claim 1 wherein the rear upper edges of said slats are spaced forwardly from the rear edges of said marginal frame portions.

4. A plastic shutter as claimed in claim 1 further including a narrow slat stiffening portion extending parallel to said inner side surfaces of said marginal frame portions and being spaced therebetween, said slat stiffening portion connecting said slats to one another rearwardly thereof.

5. A plastic shutter as claimed in claim 4 wherein the forward edge of said slat stiffening portion is contiguous with the front surface and lower edge portion of said slats and extends from the lower edge portion of an upper slat to the upper edge of a lower next succeeding slat.

6. An integrally molded one-piece plastic shutter including marginal frame portions of generally U-shaped configuration providing peripheral front surfaces including top, bottom and side surfaces peripheral inner and outer surfaces including top, bottom and side surfaces and peripheral inner and outer rear edges including top, bottom and side edges a plurality of discrete slats extending between said inner side surfaces said slats being generally flat with front surfaces sloping downwardly from their upper rearward edges in a direction from the inner peripheral rear side edges of said marginal frame portions downwardly toward the peripheral front side surfaces of said marginal frame portions the front bottom edges of said slats being spaced rearwardly from the front surfaces of said marginal frame portions and the rear upper edges of said slats being spaced forwardly from the rear edges of said marginal frame portions said slats having a lower forward edge portion extending rearwardly beyond the rear surfaces thereof providing a thickened bottom edge surface said slats being parallel to one another and being spaced from one another both in a direction along said inner side surfaces of said marginal frame portions and in a direction perpendicular to the plane of said slats, providing substantial openings between their rearwardly extending lower edge portions and their upper edges to simulate the appearance of a conventional wooden shutter.

7. A plastic shutter as claimed in claim 6, further including a narrow slat stiffening portion extending parallel to said inner side surfaces of said marginal frame portions and being spaced therebetween said slat stiffening portion connecting said slats to one another rearwardly thereof the forward edge of said slat stiffening portion being contiguous with the front surface and lower edge portion of said slats and extending from the lower edge portion of an upper slat to the upper edge of a lower next succeeding slat.

* * * * *